US010720123B2

(12) United States Patent
Liu et al.

(10) Patent No.: US 10,720,123 B2
(45) Date of Patent: Jul. 21, 2020

(54) SELF-ADJUSTING CURVED DISPLAY SCREEN

(71) Applicant: International Business Machines Corporation, Armonk, NY (US)

(72) Inventors: Su Liu, Austin, TX (US); Jinho Lee, Austin, TX (US); Eric J. Rozner, Austin, TX (US); Inseok Hwang, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/153,321

(22) Filed: Oct. 5, 2018

(65) Prior Publication Data

US 2020/0111441 A1 Apr. 9, 2020

(51) Int. Cl.
*G09G 5/00* (2006.01)

(52) U.S. Cl.
CPC ..... *G09G 5/003* (2013.01); *G09G 2354/00* (2013.01); *G09G 2380/02* (2013.01)

(58) Field of Classification Search
CPC ..... G09G 5/003
USPC ..... 345/156, 175, 419; 386/224
See application file for complete search history.

(56) References Cited

U.S. PATENT DOCUMENTS 6,334,063 B1 12/2001 Charlier et al.
7,027,054 B1 * 4/2006 Cheiky ..... G06T 13/40 345/473
8,537,174 B2 9/2013 Capener
9,058,758 B2 6/2015 Shin et al.
9,690,145 B2 6/2017 Chen et al.
9,891,442 B2 * 2/2018 Gu ..... G02B 27/2271
(Continued)

FOREIGN PATENT DOCUMENTS

CN 204667202 U 9/2015
CN 103854571 B 4/2016
(Continued)

OTHER PUBLICATIONS

Tom, "Why Choose a Curved Monitor?" Samsung Discover, Apr. 2016, pp. 1-7, retrieved from http://www.samsung.com/uk/discover/computing/why-choose-a-curved-monitor/.
(Continued)

*Primary Examiner* — Prabodh M Dharia
(74) *Attorney, Agent, or Firm* — Zilka-Kotab, P.C.

(57) ABSTRACT

A computer-implemented method, according to one embodiment, includes: detecting two or more users, and determining a location of each of the two or more users with respect to a current configuration of a curved display screen by determining a distance between each user and a respective reference point on the curved display screen, and determining, for each user, an angle between a radius of curvature which extends from the respective reference point on the curved display screen and a line extending between the user and the reference point. The locations of the two or more users are further used to determine an optimal configuration of the curved display screen. One or more instructions to rotate the curved display screen according to the optimal angular position are sent. Moreover, one or more instructions to adjust a curvature of the curved display screen according to the optimal curvature are also sent.

17 Claims, 6 Drawing Sheets

(56) References Cited

U.S. PATENT DOCUMENTS

| | | | | |
|---|---|---|---|---|
| 10,242,280 | B2 * | 3/2019 | Krafka | G06K 9/2081 |
| 10,417,667 | B1 * | 9/2019 | Agostino | G06Q 30/0269 |
| 2005/0231474 | A1 | 10/2005 | Su et al. | |
| 2006/0187195 | A1 | 8/2006 | Chung | |
| 2010/0007665 | A1 * | 1/2010 | Smith | G06T 13/40 345/473 |
| 2010/0057656 | A1 * | 3/2010 | Kuck | G06N 7/00 706/46 |
| 2010/0135643 | A1 * | 6/2010 | Fleming | G11B 27/034 386/224 |
| 2011/0291988 | A1 * | 12/2011 | Bamji | G06F 3/0428 345/175 |
| 2012/0038635 | A1 * | 2/2012 | Stamate | G02B 27/2264 345/419 |
| 2012/0154294 | A1 * | 6/2012 | Hinckley | G06F 1/1649 345/173 |
| 2013/0278631 | A1 * | 10/2013 | Border | G06F 3/04842 345/633 |
| 2016/0224803 | A1 * | 8/2016 | Frank | G06F 16/24578 |
| 2016/0372083 | A1 * | 12/2016 | Taite | G09G 5/14 |
| 2017/0038928 | A1 * | 2/2017 | Park | G06T 3/4092 |
| 2017/0052751 | A1 * | 2/2017 | Aurongzeb | H04N 7/15 |
| 2017/0127535 | A1 * | 5/2017 | Shin | G02F 1/1333 |
| 2017/0237971 | A1 * | 8/2017 | Pitts | H04N 13/232 345/419 |
| 2017/0309096 | A1 * | 10/2017 | Iyer | G07C 9/00007 |
| 2017/0353391 | A1 * | 12/2017 | Piecuch | H04L 47/521 |
| 2018/0364802 | A1 * | 12/2018 | Cederlund | G06F 3/038 |
| 2019/0098290 | A1 * | 3/2019 | Baran | H04N 13/122 |

FOREIGN PATENT DOCUMENTS

| | | | |
|---|---|---|---|
| CN | 106792180 | A | 5/2017 |
| CN | 106851356 | A | 6/2017 |
| JP | 5202448 | B2 | 6/2013 |
| KR | 20160098732 | A | 8/2016 |

OTHER PUBLICATIONS

Annis, C., "Flexible displays: throwing a technology curve," IHS Markit, Apr. 30, 2015, 6 pages, retrieved from https://ihsmarkit.com/research-analysis/q22-flexible-displays-throwing-a-technology-curve.html.

Seppala, T., "Samsung's 105-inch curved UHD TV and 85-inch bendable screen hit retail this year," engadget, Jan. 8, 2014, 10 pages, retrieved from https://www.engadget.com/2014/01/08/samsung-uhd-release-window/.

Epstein, Z., "This might be the most exciting announcement from CES," BGR, 5 pages, retrieved from https://bgr.com/2016/01/04/foldable-display-lg-announcement-ces-2016/.

* cited by examiner

SELF-ADJUSTING CURVED DISPLAY SCREEN

BACKGROUND

The present invention relates to curved display devices, and more specifically, this invention relates to adjusting the curvature and/or orientation of flexible display devices.

An electric powered display device is an output device which typically presents information in a visual form and has frequently been used in the development of display technologies. Over time electronic display devices have included liquid crystal display (LCD) devices, organic light emitting diode (OLED) display devices, and electroluminescent display (ELD) devices, among others. Moreover, these electronic display devices are used in various electronic components such as televisions, laptop computers, audio players, cellular phones, etc.

Electronic display devices have historically been formed as flat, two-dimensional panels, however recent developments have revealed that display devices having a curved screen may be more suitable for some users and/or in certain situations. For example, a curved electronic display device provides an immersive experience by allowing a wider field, of view in comparison to a flat electronic display device. Accordingly, curved electronic display devices have emerged as a viable alternative to flat electronic display devices.

While curved electronic display devices provide certain advantages over flat electronic display devices, they also suffer from unique performance limitations. For instance, curved electronic display devices have a preferred viewing position which is directly along the central axis of the screen, with the central point of the curved screen at eye level. Viewers oriented in any other position experience degradations in picture quality ranging anywhere from minor to severe, the most notable being trapezoidal distortion.

Accordingly, while a curved electronic display=device provides an improved viewing experience in certain circumstances, the fixed curvature of such an electronic display device also serves as a limitation thereof.

SUMMARY

A computer-implemented method, according to one embodiment, includes: detecting two or more users in proximity to a curved display screen, and determining a location of each of the two or more users with respect to a current configuration of the curved display screen. In preferred approaches the curved display screen is a flexible display screen. Determining the location of each of the two or more users with respect to a current configuration of the curved display screen includes determining a distance between each user and a respective reference point on the curved display screen, and determining, for each user, an angle between a radius of curvature which extends from the respective reference point on the curved display screen and a line extending between the user and the reference point. The locations of the two or more users are further used to determine an optimal configuration of the curved display screen, where the optimal configuration of the curved display screen includes an optimal angular position of the curved display screen and an optimal curvature. One or more instructions to rotate the curved display screen according to the optimal angular position are sent. One or more instructions to adjust a curvature of the curved display screen according to the optimal curvature are also sent.

As a result, the curved display screen is able to selectively alter the angular position and/or actual curvature thereof in such a way that the configuration of the display device can be adjusted to best suit the given situation. As a result, the number, location, orientation, emotional state, etc. of users in proximity to the curved display screen are taken into consideration in order to achieve an optimal configuration of the curved display screen which provides a viewing experience that takes the location of each user into account. This is particularly desirable as the optimal configuration of the curved display screen, when implemented, is able to minimize the amount of degradation in picture quality (e.g., such as trapezoidal distortion) experienced among the users as a whole in other words, some of the approaches included herein are able to derive an optimal configuration of the curved display screen which maximizes the combined viewing experience of the users.

In some approaches, weights are further assigned to each of the two or more users. The weight assigned to a given user is based on an orientation of the given user with respect to the curved display screen and/or an emotional state of the given user. Moreover, the weights assigned to the two or more users are further used to determine the optimal configuration of the curved display screen. It follows that some of the approaches herein are able to derive an optimal configuration of the curved display screen which maximizes the weighted viewing experience of the users based on their respective orientation, emotional state, field of view, etc., with respect to the curved display screen.

The location of each of the two or more users with respect to the current configuration of the curved display screen is further monitored in some approaches. Monitoring these locations allows for a determination to be made as to whether the location of any of the two or more users has changed. In response to determining that the location of at least one of the two or more users has changed, the location of each of the two or more users with respect to the current configuration of the curved display screen is redetermined. Moreover, the redetermined locations of the two or more users are used to determine an updated optimal configuration of the curved display screen. One or more instructions to rotate the curved display screen according to the updated optimal angular position are sent, and one or more instructions to adjust a curvature of the curved display screen according to the updated optimal curvature are also sent. This is particularly desirable as the optimal configuration of the curved display screen is updated over time as circumstances (e.g., such as the location of each of the users) change. Thus, by monitoring these locations, the approach is able to consistently minimize the amount of degradation in picture quality (e.g., such as trapezoidal distortion) experienced among the users as a whole over time.

A computer program product, according to another embodiment, includes a computer readable storage medium having program instructions embodied therewith. The computer readable storage medium is not a transitory signal per se. Moreover, the program instructions are readable and/or executable by a processor to cause the processor to perform the processes of the above mentioned computer-implemented method. Accordingly, the present embodiment is able to achieve the same or similar improvements to the storage system as those described above.

A system, according to yet another embodiment, includes: a processor; and logic integrated with the processor, executable by the processor, or integrated with and executable by the processor, the logic being configured to perform the processes of the above mentioned computer-implemented method. Accordingly, the present embodiment is able to achieve the same or similar improvements to the storage system as those described above.

Other aspects and embodiments of the present invention will become apparent from the following detailed description, which, when taken in conjunction with the drawings, illustrate by way of example the principles of the invention.

DETAILED DESCRIPTION

Figure 1:
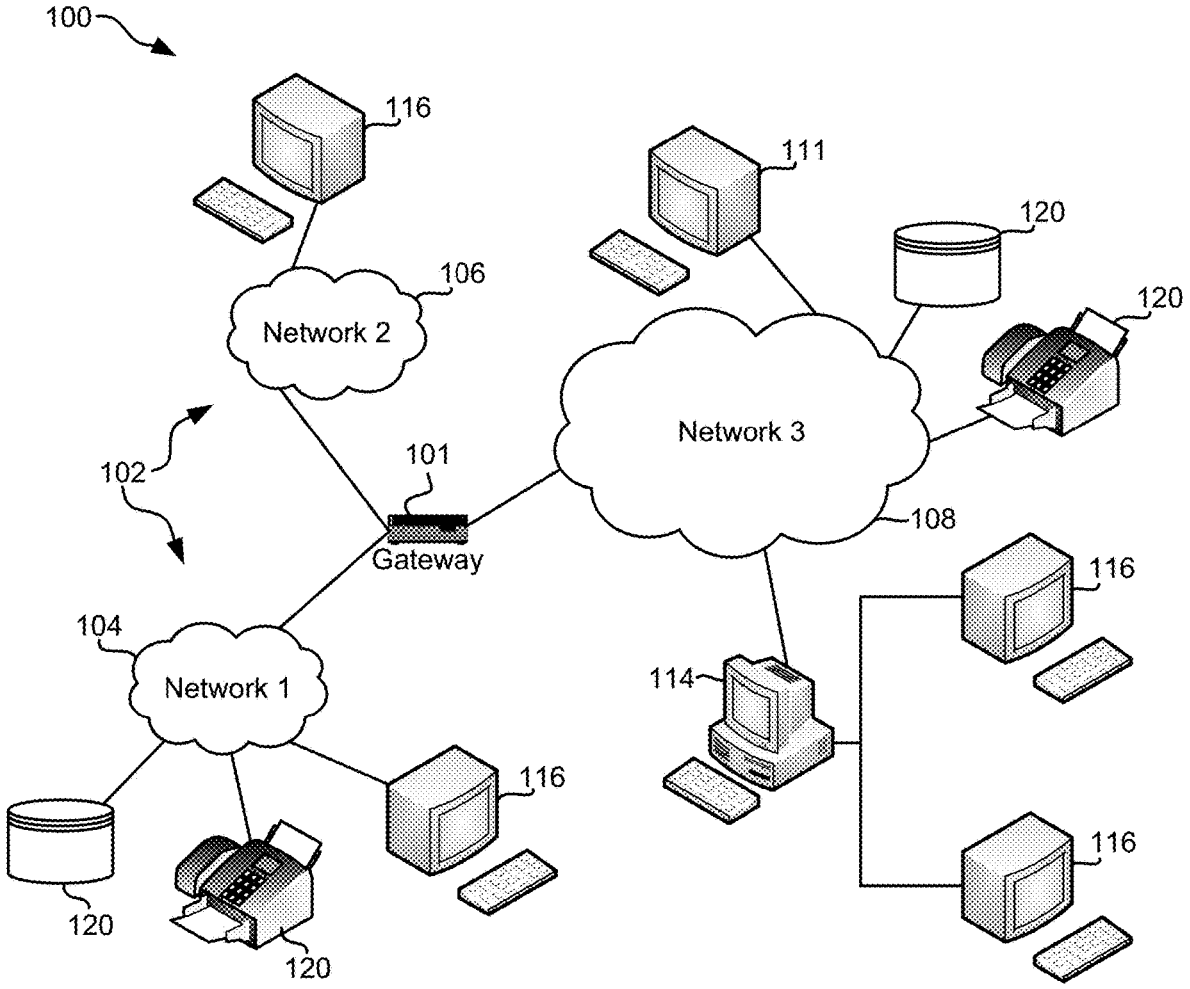
FIG. 1 is a representational view of a network architecture.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The following description discloses several preferred approaches of systems, methods and computer program products which involve a curved display screen which is able to adjust the angular position and/or actual curvature thereof in such a way that the configuration of the display device can be adjusted to best suit the given situation. As a result, the number, location, orientation, emotional state, etc. of users in proximity to the curved display screen are taken into consideration in order to achieve an optimal configuration of the curved display screen which provides a viewing experience that takes the location of each user into account, e.g., as will be described in further detail below.

In one general embodiment, a computer-implemented method includes: detecting two or more users in proximity to a curved display screen, and determining a location of each of the two or more users with respect to a current configuration of the curved display screen. In preferred approaches the curved display screen is a flexible display screen. Determining the location of each of the two or more users with respect to a current configuration of the curved display screen includes determining a distance between each user and a respective reference point on the curved display screen, and determining, for each user, an angle between a radius of curvature which extends from the respective reference point on the curved display screen and a line extending between the user and the reference point. The locations of the two or more users are further used to determine an optimal configuration of the curved display screen, where the optimal configuration of the curved display screen includes an optimal angular position of the curved display screen and an optimal curvature. One or more instructions to rotate the curved display screen according to the optimal angular position are sent. One or more instructions to adjust a curvature of the curved display screen according to the optimal curvature are also sent.

In another general embodiment, a computer program product includes a computer readable storage medium having program instructions embodied therewith. The computer readable storage medium is not a transitory signal per se. Moreover, the program instructions are readable and/or executable by a processor to cause the processor to perform the processes of the above mentioned computer-implemented method.

In yet another general embodiment, a system includes: a processor; and logic integrated with the processor, executable by the processor, or integrated with and executable by the processor, the logic being configured to perform the processes of the above mentioned computer-implemented method.

FIG. 1 illustrates an architecture 100, in accordance with one embodiment. As shown in FIG. 1, a plurality of remote networks 102 are provided including a first remote network 104 and a second remote network 106. A gateway 101 may be coupled between the remote networks 102 and a proximate network 108. In the context of the present architecture 100, the networks 104, 106 may each take any form including, but not limited to a local area network (LAN), a wide area network (WAN) such as the Internet, public switched telephone network (PSTN), internal telephone network, etc.

In use, the gateway 101 serves as an entrance point from the remote networks 102 to the proximate network 108. As such, the gateway 101 may function as a router, which is capable of directing a given packet of data that arrives at the gateway 101, and a switch, which furnishes the actual path in and out of the gateway 101 for a given packet.

Further included is at least one data server 114 coupled to the proximate network 108, and which is accessible from the remote networks 102 via the gateway 101. It should be noted that the data server(s) 114 may include any type of computing device/groupware. Coupled to each data server 114 is a plurality of user devices 116. User devices 116 may also be connected directly through one of the networks 104, 106, 108. Such user devices 116 may include a desktop computer, lap-top computer, hand-held computer, printer or any other type of logic. It should be noted that a user device 111 may also be directly coupled to any of the networks, in one approach.

A peripheral 120 or series of peripherals 120, e.g., facsimile machines, printers, networked and/or local storage units or systems, etc., may be coupled to one or more of the networks 104, 106, 108. It should be noted that databases and/or additional components may be utilized with, or integrated into, any type of network element coupled to the networks 104, 106, 108. In the context of the present description, a network element may refer to any component of a network.

According to some approaches, methods and systems described herein may be implemented with and/or on virtual systems and/or systems which emulate one or more other systems, such as a UNIX system which emulates an IBM z/OS environment, a UNIX system which virtually hosts a MICROSOFT WINDOWS environment, a MICROSOFT WINDOWS system which emulates an IBM z/OS environment, etc. This virtualization and/or emulation may be enhanced through the use of VMWARE software, in some approaches.

In more approaches, one or more networks 104, 106, 108, may represent a cluster of systems commonly referred to as a "cloud." In cloud computing, shared resources, such as processing power, peripherals, software, data, servers, etc., are provided to any system in the cloud in an on-demand relationship, thereby allowing access and distribution of services across many computing systems. Cloud computing typically involves an Internet connection between the systems operating in the cloud, but other techniques of connecting the systems may also be used.

Figure 2:
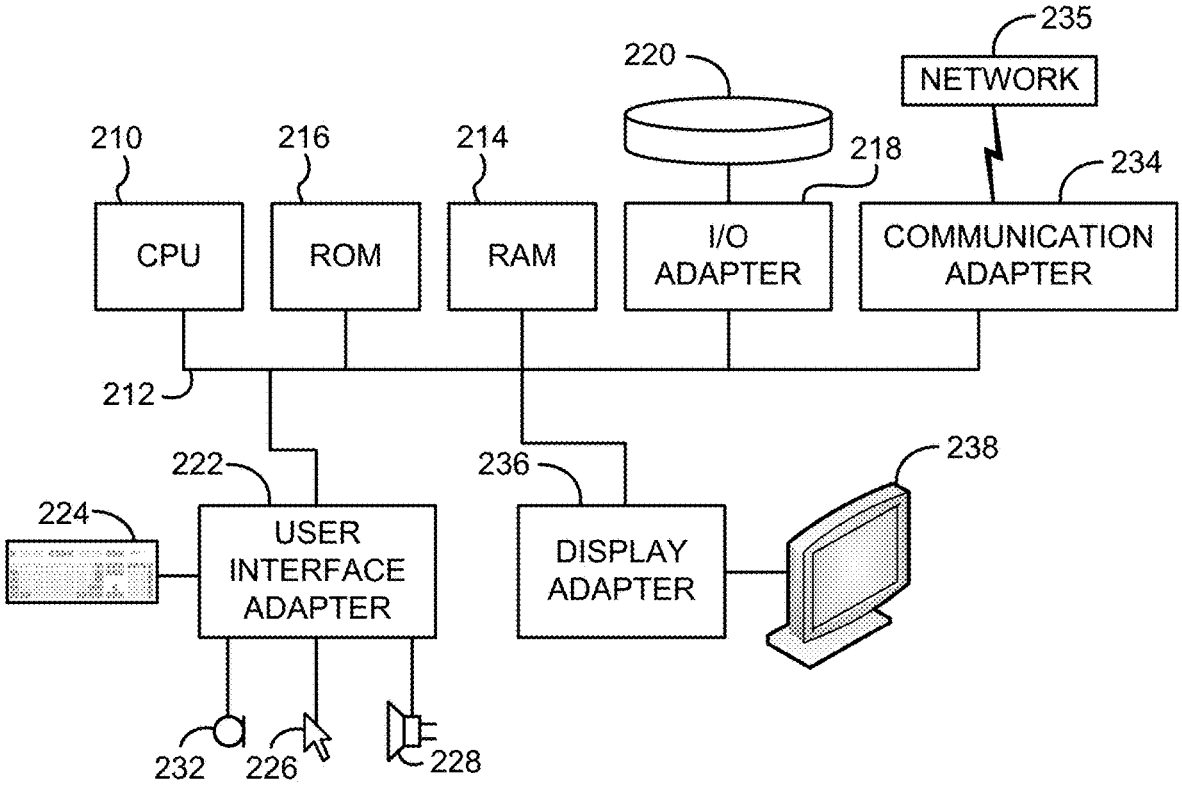
FIG. 2 is a representative hardware environment that may be associated with the servers and/or clients of FIG. 1.

FIG. 2 shows a representative hardware environment associated with a user device 116 and/or server 114 of FIG. 1, in accordance with one approach. Such figure illustrates a typical hardware configuration of a workstation having a central processing unit 210, such as a microprocessor, and a number of other units interconnected via a system bus 212.

The workstation shown in FIG. 2 includes a Random Access Memory (RAM) 214, Read Only Memory (ROM) 216, an input/output (I/O) adapter 218 for connecting peripheral devices such as disk storage units 220 to the bus 212, a user interface adapter 222 for connecting a keyboard 224, a mouse 226, a speaker 228, a microphone 232, and/or other user interface devices such as a touch screen and a digital camera (not shown) to the bus 212, communication adapter 234 for connecting the workstation to a communication network 235 (e.g., a data processing network) and a display adapter 236 for connecting the bus 212 to a display device 238.

The workstation may have resident thereon an operating system such as the Microsoft Windows® Operating System (OS), a MAC OS, a UNIX OS, etc. It will be appreciated that a preferred approach may also be implemented on platforms and operating systems other than those mentioned. A preferred approach may be written using eXtensible Markup Language (XML), C, and/or C++ language, or other programming languages, along with an object oriented programming methodology. Object oriented programming (OOP), which has become increasingly used to develop complex applications, may be used.

Of course, this logic may be implemented as a method on any device and/or system or as a computer program product, according to various approaches.

As previously mentioned, electronic display devices have historically been formed as flat, two-dimensional panels. However, recent developments have revealed that display devices having a curved screen may be more suitable for some users and/or in certain situations. For example, a curved electronic display device provides an immersive experience by allowing a wider field of view in comparison to a flat electronic display device. Accordingly, curved electronic display devices have emerged as a viable improvement to flat electronic display devices.

While, curved electronic display devices provide certain advantages over flat electronic display devices, they also suffer from unique performance limitations. For instance, curved electronic display devices have a preferred viewing position which usually is along the central axis of the screen, with the central point of the curved screen at eye level. Viewers oriented in any other position experience degradations in picture quality ranging anywhere from minor to severe, the most notable being trapezoidal distortion.

Accordingly, while a curved electronic display device provides an improved viewing experience in certain circumstances, the fixed curvature of such an electronic display device also serves as a limitation thereof. It follows that an electronic display device which is not limited to a specific configuration would increase the applicability thereof.

In sharp contrast, flexible electronic displays are electrically powered visual displays which are flexible in nature along the surface (or plane) of the display itself, and are a viable alternative to rigid electronic display devices. Various ones of the approaches included herein implement flexible electronic displays in such a way that the configuration of a given display device is not fixed following the manufacture thereof. As a result, some of the approaches included herein are able to selectively adjust the curvature (or lack thereof) and/or orientation of a display device such that the display device is best suited for the given situation. This significantly increases the applicability of a given display device as well as the quality of performance, e.g., as will be described in further detail below.

Figure 3A:
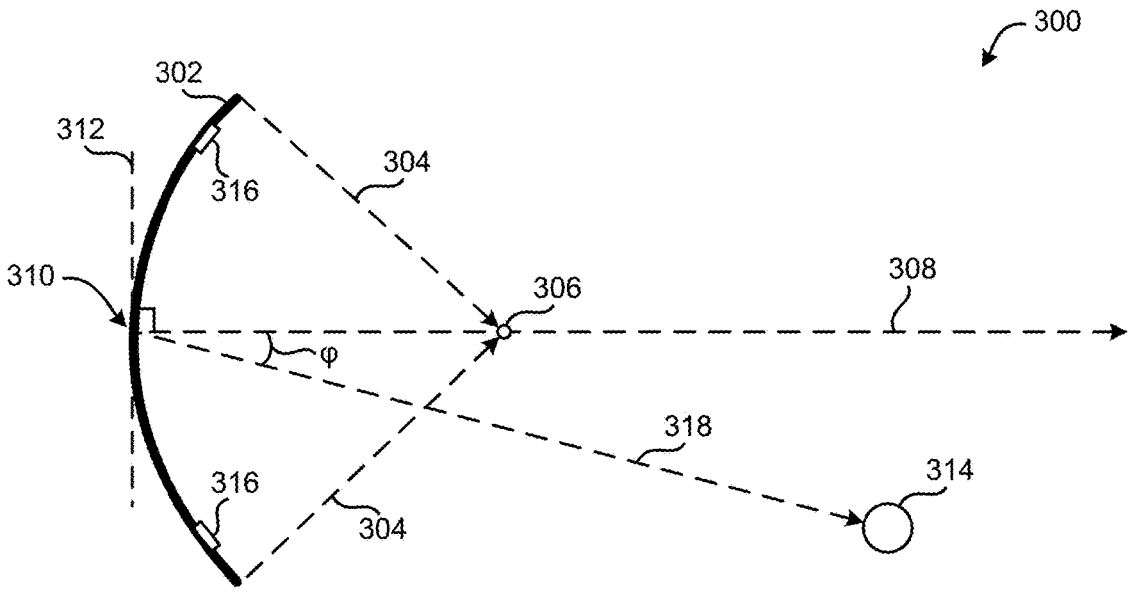
FIGS. 3A-3B are representational views of a viewing environment.

Looking now to FIG. 3A, a curved display screen 302 having a particular curvature is depicted in a viewing environment 300 in accordance with one embodiment. As an option, the present curved display screen 302 may be implemented in conjunction with features from any other approaches listed herein, such as those described with reference to the other FIGS. However, such curved display screen 302 and others presented herein may be used in various applications and/or in permutations which may or may not be specifically described in the illustrative approaches listed herein. Further, the curved display screen 302 presented herein may be used in any desired environment.

As mentioned above, the curved display screen 302 has a specific curvature which is preferably significantly uniform. In other words, the curved shape of the display screen 302 may theoretically be extended in a same fashion from the outermost edges thereof to form a complete circle. Accordingly, the curvature of the display screen 302 may be represented (or quantified) by a radius of curvature which equals the radius of a circular arc which best represents the curved surface. Thus, the curvature of the display screen 302 may be determined by extending a radius of curvature from an arbitrary point along the curved surface of the display screen 302 to a center thereof.

As shown, a radius of curvature 304 is shown as extending from a reference point at either end of the curved display screen 302, meeting at a center 306 of the curved display screen 302 according to the present configuration. Moreover, a center point 310 along a length of the curved display screen 302 is identified by the center line 308 which extends therefrom. The center line 308 further extends from the center point 310 such that it is perpendicular to a tangent 312 of the center point 310. It should be noted that the center 306 of the curved display screen 302 is different than the center point 310 along a length of the curved display screen 302 as shown. As mentioned above, the center of a circular arc which best represents the extended shape of the curved display screen 302, while the center point 310 of the curved display screen 302 is an actual point on the surface of the curved display screen 302 itself. Accordingly, the "center of the curved display screen" and the "center point of the curved display screen" as used herein are in no way intended to limit the invention, e.g., as would be appreciated by one skilled in the art after reading the present description.

In some approaches, the center 306 of the curved display screen 302 provides the optimal viewing position with respect to images that are shown on the curved display screen 302. In other words, a user positioned at the center 306 of the curved display screen 302 would enjoy the best viewing experience in comparison to being positioned at any other location relative to the surface of the curved display screen 302. However, it should be noted that the optimal viewing position may vary depending on preferences, environmental conditions, screen type, etc. It follows that the description included herein is in no way intended to be limiting, and the "optimal viewing position" may be adjusted depending on the desired approach and/or the situation, e.g., such as situations involving more than one user.

Referring still to FIG. 3A, a user 314 is also present in the viewing environment 300. As shown, the user 314 is positioned in proximity to the curved display screen 302, but not at the optimal viewing position at the center 306 of the curved display screen 302. One or more detectors 316 coupled to (or at least positioned adjacent to) the curved display screen 302 are preferably able to detect the user's 314 presence when in range and determine the user's 314 location (e.g., position) with respect to the current configuration of the curved display screen 302. In other words, the detectors 316 are preferably able to detect the user 314 as well as a distance separating the user 314 from one or more reference points on or near the curved display screen 302, an angular separation between the user 314 and the center line 308, etc. With respect to the present description, it should be noted that the "angular separation" between the user 314 and the center line 308 is represented by angle φ which extends between the center line 308 (or another radius of curvature) and an imaginary line 318 extending between the user 314 and the center point 310 which serves as the same reference point for the two lines.

Figure 3B:
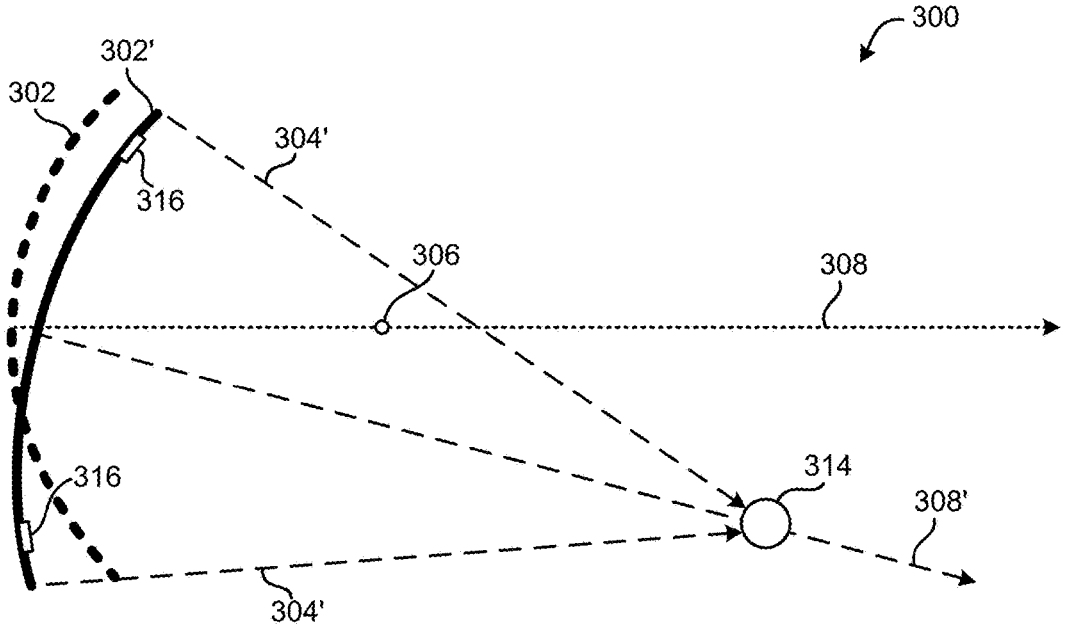

Depending on the approach, the detectors 316 may be the same, similar, or different types of detectors. Moreover, the number and/or configuration of the detectors 316 illustrated in FIGS. 3A-3B are in no way intended to limit the invention, but rather are presented by way of example. An illustrative list of detectors 316 which may be implemented includes, but is in no way limited to, depth sensors, cameras, infrared sensors, ultrasonic sensors, wireless receivers capable of communicating with wireless transceivers associated with (e.g., coupled and/or held by) the users, microphones, etc.

The location of the user 314 with respect to the orientation and/or center of the curved display screen 302 is thereby used to determine an amount by which the curvature and/or angular orientation of the curved display screen 302 should be adjusted in order to cause the user's 314 location to be the optimal viewing position. This determination is further implemented such that the curvature and/or angular orientation of the curved display screen 302 actually changes, e.g., as seen in FIG. 3B.

Looking now to FIG. 3B, the original configuration of the curved display screen 302 has been adjusted such that the updated curved display screen 302' has a radius of curvature 304' which overlaps with the user's 314 location. Moreover, the updated curved display screen 302' has been rotated such that the center line 308' also extends from the center point 310 through the user's 314 location. The detectors 316 also preferably monitor the user's 314 location in order to determine whether any further adjustments to the curvature and/or angular orientation of the updated curved display screen 302' should be adjusted again. It follows that the implementation illustrated in FIGS. 3A-3B is able to continuously adjust the configuration of the curved display screen such that a user is able to experience an optimal viewing experience regardless of whether their location with respect to the screen changes during use.

However, as additional users are introduced to the environment, the process of maintaining an optimal viewing experience becomes increasingly difficult. This primarily stems from the fact that the optimal viewing position for each one of the users is different, and yet the curved display screen can only have one configuration at a time. Looking to FIG. 4A, the flowchart of a method 400 for determining, facilitating and maintaining an optimal configuration of a curved display screen regardless of the number of users that are present is shown according to one embodiment. The method 400 may be performed in accordance with the present invention in any of the environments depicted in FIGS. 1-3B, among others, in various approaches. Of course, more or less operations than those specifically described in FIG. 4A may be included in method 400, as would be understood by one of skill in the art upon reading the present descriptions.

Each of the steps of the method 400 may be performed by any suitable component of the operating environment. For example, in various approaches, the method 400 may be partially or entirely performed by a controller, a processor, a computer, etc., or some other device having one or more processors therein. Thus, in some approaches, method 400 may be a computer-implemented method. Moreover, the terms computer, processor and controller may be used interchangeably with regards to any of the approaches herein, such components being considered equivalents in the many various permutations of the present invention.

Moreover, for those approaches having a processor, the processor, e.g., processing circuit(s), chip(s), and/or module(s) implemented in hardware and/or software, and preferably having at least one hardware component may be utilized in any device to perform one or more steps of the method 400. Illustrative processors include, but are not limited to, a central processing unit (CPU), an application specific integrated circuit (ASIC), a field programmable gate array (FPGA), etc., combinations thereof, or any other suitable computing device known in the art.

Figure 4A:
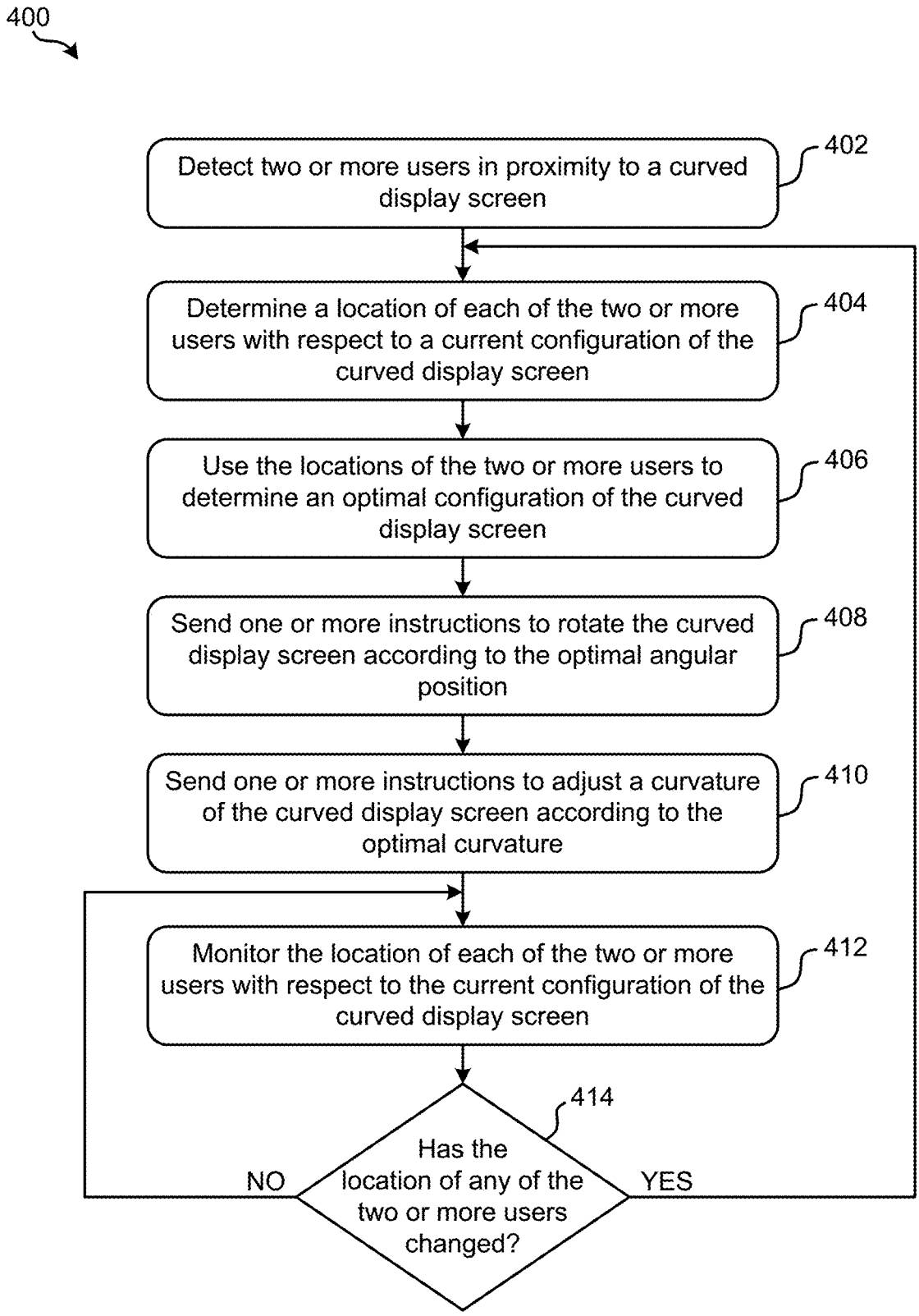
FIG. 4A is a flowchart of a method.

As shown in FIG. 4A, operation 402 of method 400 includes detecting two or more users in proximity to a curved display screen. As mentioned above, one or more detectors coupled to and/or positioned near the curved display screen may be used to detect any number of users in proximity to the curved display screen. An illustrative list of detectors which may be used to perform operation 402 includes, but is in no way limited to, depth sensors, cameras, infrared sensors, ultrasonic sensors, wireless receivers capable of communicating with wireless transceivers associated with (e.g., coupled and/or held by) the users, microphones, etc.

Figure 4B:
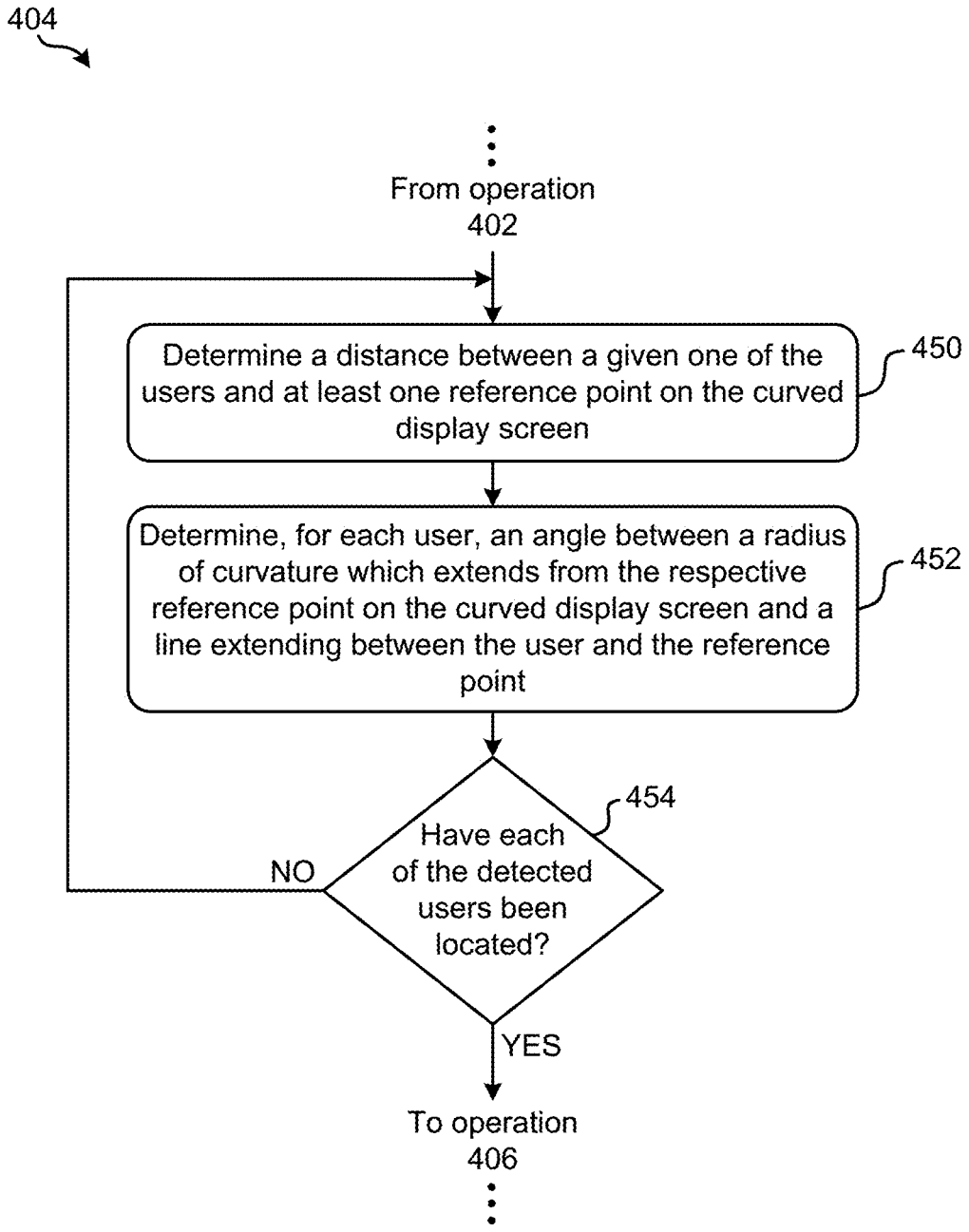
FIG. 4B is a flowchart of sub-processes for one of the operations in the method of FIG. 4A.

Upon detecting the two or more users in proximity to a curved display screen, operation 404 includes determining a location of each of the two or more users with respect to a current configuration of the curved display screen. As mentioned above, the location of a given user with respect to the current configuration of the curved display screen is represented in some approaches by a distance which separates the given user from one or more reference points on or near the curved display screen, as well as an angular separation between the given user and a center line of the curved display screen. For instance, referring momentarily to FIG. 4B, exemplary sub-processes of determining a location of each of the two or more users with respect to a current configuration of the curved display screen are illustrated in accordance with a preferred approach, one or more of which may be used to perform operation 404 of FIG. 4A. However, it should be noted that the sub-processes of FIG. 4B are illustrated in accordance with one approach which is in no way intended to limit the invention.

As shown, the flowchart includes determining a distance between a given one of the users and at least one reference point on the curved display screen. See sub-operation 450. The distance separating the user and each of the reference points on the curved display screen may be determined a number of ways depending on the approach. For instance, in some approaches a depth sensor is coupled to the curved display screen which can be used to accurately determine the desired distance. In other approaches an ultrasonic sensor is coupled to the curved display screen and can be used to transmit ultrasonic signals and detect ones of the transmitted signals which are reflected off the user to determine a distance therebetween.

Sub-operation 452 further includes determining, for each user, an angle between a radius of curvature which extends from the respective reference point on the curved display screen and a line extending between the user and the reference point. For example, refer back to angle φ in FIG. 3A which extends between the center line 308 (or another radius of curvature) and an imaginary line 318 that extends between the user 314 and the center point 310 which serves as the same reference point for the two lines. Referring again to FIG. 4B, this angular separation may be determined using any processes and/or components which would be apparent to one skilled in the art after reading the present description. For example, a one or more depth sensors are used in conjunction with an internal compass or some form of a protractor to determine an angle between any two distant points.

From sub-operation 452, the flowchart proceeds to decision 454 which determines whether each of the detected users have been located. In response to determining that one or more of the users have not yet been located, sub-operations 450 and 452 are repeated for a subsequent user. It follows that the sub-processes included in FIG. 4B may be repeated in an iterative fashion until the location of each of the users detected in proximity to the curved display screen has been determined. Accordingly, the flowchart returns to operation 406 of FIG. 4A in response to determining that each of the users have been located.

Returning to FIG. 4A, operation 406 includes using the locations of the two or more users to determine an optimal configuration of the curved display screen. As mentioned above, the center of the curved display screen provides the optimal viewing position for a single viewer (e.g., user) with respect to images that are shown on the curved display screen. In other words, a user positioned at the center of the curved display screen would enjoy the best viewing experience in comparison to being positioned at any other location relative to the surface of the curved display screen. However, as additional users are introduced to the environment, the process of maintaining an optimal viewing experience becomes increasingly difficult. This primarily stems from the fact that the optimal viewing position for each one of the users is different, and yet the curved display screen can only have one configuration at a time.

The optimal configuration of the curved display screen when dealing with two or more users in proximity to the curved display screen preferably minimizes the average viewing angle, as measured from a center line (e.g., see φ in FIG. 3A above), among the multiple users. In other words, the optimal configuration of the curved display screen preferably adjusts the screen such that on average, each user in proximity to the curved display screen has a viewing angle which is as close as possible to the center line extending from a center of the screen. However, as the viewing angle of one of the users is improved, the viewing angle of one or more of the remaining users is typically worsened. Thus, the location of each of the users is preferably taken into consideration when determining the optimal configuration of the curved display screen.

This optimal configuration of the curved display screen is defined in preferred approaches by an optimal curvature and an optimal angular position which provides a viewing experience that takes the location of each user into account. According to an example, which is in no way intended to limit the invention, Equation 1 provides an algorithm which may be used to determine the optimal configuration of the curved display screen.

$$\text{optimal}(r, c) = \text{argmin}_{r,c} \sum_{u \in users} \frac{1}{\varphi_{end}(u) - \varphi_{start}(u)} \int_{\varphi_{start}(u)}^{\varphi_{end}(u)} \theta(r, c, \varphi) d\varphi \qquad \text{Equation 1}$$

Again, Equation 1 is used in some approaches to determine the optimal configuration of the curved display screen which is defined in terms of the curvature "c" and rotational position "r" of the curved display screen. Moreover, $\text{argmin}_{r,c}$ attempts to minimize the average viewing angle by evaluating each of the possible curvatures and rotational positions of the curved display screen as shown by the summation operator and integral.

Figure 4C:
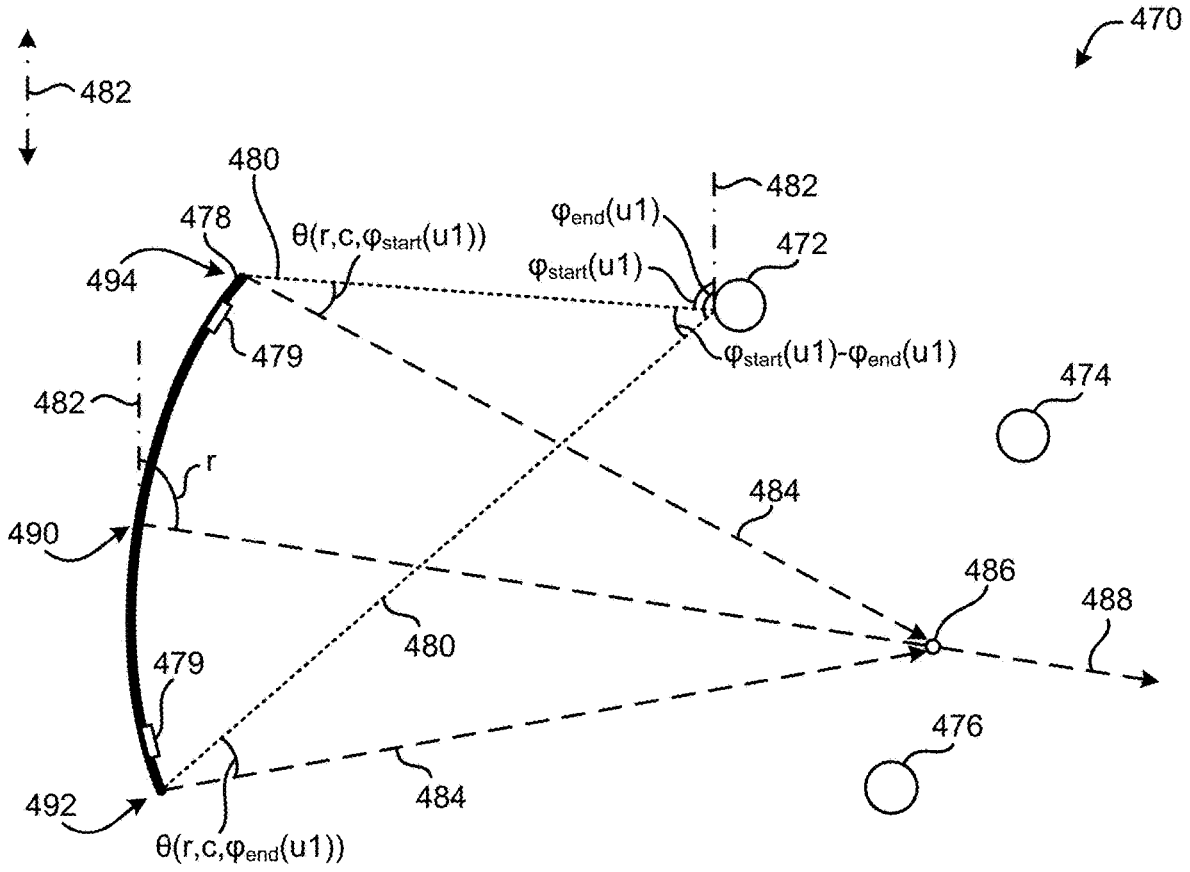
FIG. 4C is a representational view of a viewing environment.

Variables $\varphi_{start}$(u) and φend(u) pertain to angular relationships which define the location of a user "u" with respect to reference points on the curved display screen. For example, looking momentarily to FIG. 4C, an environment 470 having three users 472, 474, 476 in proximity to a curved display screen 478 having detectors 479 is illustrated. Looking to a first of the users 472, imaginary lines 480 extend between the user 472 and reference points on the curved display screen 478. In the present approach, the reference points are located on opposite ends of the curved display screen 478, but any number of reference points at any location along the curved display screen 478 may be used depending on the desired approach.

A reference line 482 has also been defined in the present approach for reference, and is in no way intended to limit the invention. The reference line 482 can be oriented in any direction depending on the desired approach, but is used to define the angular relationship between various ones of the imaginary lines introduced in FIG. 4C. For example, $\varphi_{start}$(u1) is shown as being the angle which separates the imaginary line 480 extending between the first user 472 and a reference point on a first end 492 of the curved display screen 478, while $\varphi_{end}$(u1) is the angle which separates the imaginary line 480 extending between the first user 472 and a reference point on an opposite end 494 of the curved display screen 478. Moreover, the interior angle between the two imaginary lines 480 extending between the first user 472 and the reference points on the curved display screen 478 can be defined as being $\varphi_{start}$(u1)-φend(u1).

Again, the curvature of the curved display screen 478 can be quantified by one or more radii of curvature 484, each of which extend from an arbitrary point along the curved surface of the display screen 478 to a center 486 thereof. Again, the center 486 of the curved display screen 478 also lies along a center line 488 which extends from a center point 490 along a length of the curved display screen 478. The center line 488 further extends from the center point 490 such that it is perpendicular to a tangent (not shown) of the center point 490. The angle θ between each of the imaginary lines 480 and the respective radius of curvature 484 is illustrated as being dependent on the angle "r" which defines an angular position of the curved display screen 478 with respect to a given reference (here reference line 482), the actual curvature "c" of the curved display screen 478, and the angle φ used to define the location of a user with respect to reference points on the curved display screen. Specifically, the angle θ between the imaginary line 480 and the radius of curvature 484 which extend to the first user 472 from the reference point at the first end 492 of the curved display screen 478 depends on $\omega_{end}$(u1), while the angle θ between the imaginary line 480 and the radius of curvature 484 which extend to the first user 472 from the reference point at the opposite end 494 of the curved display screen 478 depends on $\varphi_{start}$(u1).

Again, the optimal configuration of the curved display screen when dealing with two or more users in proximity to the curved display screen preferably minimizes the average viewing angle among the multiple users. Equation 1 provides an algorithm which may be used to determine the optimal configuration of the curved display screen as defined by an optimal curvature and an optimal angular position which provides a viewing experience that takes the location of each user into account. This is particularly desirable as the optimal configuration of the curved display screen, when implemented, is able to minimize the amount of degradation in picture quality (e.g., such as trapezoidal distortion) experienced among the users as a whole. In other words. Equation 1 is able to derive an optimal configuration of the curved display screen which maximizes the combined viewing experience of the users.

However, in certain circumstances not all of the users in proximity to the curved display screen may be paying attention to what is being displayed thereon. In other words, while Equation 1 provides the valuable ability to determine the optimal configuration of the curved display screen which provides a viewing experience that takes the location of each user into account equally, other factors may be taken into consideration to further improve the combined viewing experience of the users. For instance, a user's orientation with respect to the curved display screen may be considered in addition to their general location. According to an example, while a user is in proximity to the curved display screen, they may actually be facing away from the screen, looking in a different direction, have their eyes closed, etc. Similarly, the emotional state of a given user also plays an effect on where their attention is focused. For example, a user exhibiting signals which are consistent with sadness may suggest that that user is more or less inclined to be paying attention to what is being displayed on the curved display screen. Thus, a weight may be assigned to each of the users depending on the amount of attention they are actually paying to what is being displayed on the curved display screen currently. In such approaches, facial recognition, gesture recognition, speech analysis, thermal imaging, pattern recognition, etc., or any other processes of determining the emotional state of one or more users may be implemented.

Looking to Equation 2, Equation 1 has essentially been updated to incorporate a weight $w_u$ determined for each of the users in proximity to the curved display screen in order to determine the optimal configuration thereof.

$$\text{optimal}(r, c) = \text{argmin}_{r,c} \sum_{u \in users} \frac{w_u}{\varphi_{end}(u) - \varphi_{start}(u)} \int_{\varphi_{start}(u)}^{\varphi_{end}(u)} \theta(r, c, \varphi) d\varphi \qquad \text{Equation 2}$$

As shown, in some approaches the optimal configuration of the curved display screen is affected by a weight assigned to each of the users individually, in addition to the actual locations of the users. These weights further depend on the orientation, emotional state, field of view, etc. of the respective users. For instance, in some approaches the weight assigned to a given user is based on an orientation of the given user with respect to the curved display screen and/or an emotional state of the given user.

It follows that Equation 2 provides an algorithm which can be used to determine the optimal configuration of the curved display screen as defined by an optimal curvature and an optimal angular position which provides a viewing experience that takes the location of each user into account, as well as an amount of attention each of the users are paying to what is being displayed on the curved display screen. This is also highly desirable, as the optimal configuration of the curved display screen, when implemented, is able to further improve the picture quality for those users which are paying closer attention to the curved display screen by sacrificing some picture quality for those users determined as paying less attention (or none at all) to the curved display screen, at least with respect to each other. In other words, Equation 2 is able to derive an optimal configuration of the curved display screen which maximizes the weighted viewing experience of the users.

Returning now to method 400 as illustrated in FIG. 4A, operation 406 again includes using the locations of the two or more users to determine an optimal configuration of the curved display screen using any one or more of the approaches described and/or suggested above. Moreover, the optimal configuration of the curved display screen includes an optimal angular position of the curved display screen with respect to a reference and an optimal radius of curvature. From operation 406, method 400 proceeds to operation 408 which includes sending one or more instructions to rotate the curved display screen according to the optimal angular position. In some approaches, the one or more instructions to rotate the curved display screen are sent to a control unit (e.g., controller) which is coupled to the curved display screen in some way. For example, the one or more instructions to rotate the curved display screen are sent to a control unit which is electrically coupled to one or more motors which are able to actually rotate the curved display screen such that the angular orientation of the curved display screen, with respect to some reference (e.g., see 482 of FIG. 4C above) and/or the current orientation of the curved display screen, changes. However, the one or more instructions to rotate the curved display screen according to the optimal angular position may be sent to any type of controller, motor, actuating component, etc. which would be apparent to one skilled in the art in order to facilitate the rotational movement of the curved display screen in order to achieve to the optimal angular position thereof.

Moving to operation 410, one or more instructions are sent to adjust a curvature of the curved display screen according to the optimal radius of curvature. As mentioned herein, the curvature of the curved display screen can be represented (e.g., quantified) by a radius of curvature thereof. Thus, the optimal configuration can be achieved by adjusting the curvature of the curved display screen such that a radius of curvature thereof matches the optimal radius of curvature.

As mentioned above, the curved display screen includes a flexible display screen (or "organic user interface") in preferred approaches. In other words, the curved display screen is able to display images thereon using electric and/or chemical components in response to receiving electrical signals, but is not rigid in its configuration. An illustrative list of the types of flexible display screen technologies which may be implemented in order to form the given flexible display screen includes, but is in no way limited to, Flexible OLEDs, electronic paper, etc. Thus, the curved display screen is able to display images thereon which correspond to electrical signals at a wide range of different curvatures.

In some approaches, the one or more instructions to adjust the curvature of the curved display screen are sent to a control unit (e.g., controller) which is coupled to the curved display screen in some way. For example, the one or more instructions to adjust the curvature of the curved display screen are sent to a control unit which is electrically coupled to one or more motors which are able to actually increase and/or decrease the curvature of the curved display screen such that the center of the curved display screen moves closer and/or is pushed away from the surface of the curved display screen respectively. However, the one or more instructions to adjust the curvature of the curved display screen according to the optimal radius of curvature may be sent to any type of controller, motor, actuating component, etc. which would be apparent to one skilled in the art in order to facilitate the change in curvature of the curved display screen in order to achieve to the optimal radius of curvature thereof.

For example, in some approaches the curved display screen includes a flexible display screen, a bottom cover which serves as a rear surface casing for the flexible display screen, and at least one curvature control unit coupled to a rear surface of the bottom cover. The at least one curvature control unit is preferably able to control a curvature of the bottom cover by applying tensile force to the rear surface of the bottom cover in a longitudinal direction of the bottom cover, which in turn controls a curvature of the flexible display screen. The curvature control unit may include a plurality of tightening members, a motor configured to generate power, a transmission member configured to transmit power generated from the motor to the plurality of tightening members, etc., e.g., as would be appreciated by one skilled in the art after reading the present description.

According to an illustrative approach, which is in no way intended to limit the invention, the bottom surface of the bottom cover is formed of a corrugated board including an intermediate layer provided with ridges, a first cover layer which acts as a coating for an upper surface of the intermediate layer, and a second cover layer serving as a coating for a lower surface of the intermediate layer. Thus, the first and second cover layers protect the ridged intermediate layer while also allowing for the entire curved display screen flex or otherwise change in shape to achieve virtually any desired curvature in an operable range.

With continued reference to FIG. 4A, operation 412 includes monitoring the location of each of the two or more users with respect to the current configuration of the curved display screen. Monitoring the location of each of the users is achieved in some approaches using the one or more detectors which are coupled to (or at least positioned adjacent to) the curved display screen. As mentioned above, these one or more detectors are preferably able to detect the presence of a given user when in range as well as determine a location of each of the detected users with respect to the current configuration of the curved display screen. In other words, the detectors are preferably able to detect a user as well as a distance separating the user from one or more reference points on or near the curved display screen, an angular separation between the user and a current center line of the curved display screen, etc.

The information gathered while monitoring the location of the users is further used to determine whether the location of any of the two or more users has changed. See decision 414. It should be noted that with respect to the present description, the determination of whether the location of any of the two or more users has changed is made with respect to whether any of the users have changed their location as a result of their own actions. In other words, the determination in decision 414 is not made with respect to whether the locations of any of the users change as a result of any adjustments that are made to the angular position and/or the curvature of the curved display screen, e.g., as a result of performing operation 408 and/or operation 410. Thus, the adjustments made by operation 408 and/or operation 410 are considered during the monitoring and/or when making the determination in decision 414 in order to determine whether any of the users have changed their location as a result of their own physical movement(s).

In response to determining that the location of at least one of the two or more users has changed, method 400 returns to operation 404 such that the locations of the users may continue to be monitored. Accordingly, operation 412 and decision 414 can be repeated a number of times until the location, position, emotional state, etc. of one or more of the users changes. The frequency by which the determination in decision 414 is repeated varies depending on the given approach. The sample rate by which the location of each of the users is monitored also varies depending on the particular approach. For instance, in different approaches, monitoring the location of each of the two or more users with respect to the current configuration of the curved display screen is performed at a sample rate which is in a range of about once every second to about once every fifteen minutes, more preferably about once every three seconds to about once every ten minutes, more preferably about once every five seconds to about once every five minutes, but could be higher or lower. For instance, user preferences, industry standards, types of detectors implemented, previous user movements (or lack thereof), predictive algorithms, etc., may have an effect on the sampling rate at which the monitoring is performed in operation 412.

In some approaches method 400 may be terminated as a result of an operating power of the curved display screen being terminated (e.g., the curved display screen being turned off) at which point the curved display screen may retain its current configuration, return to an "idol" configuration designed to prolong longevity of the curved display screen and/or the components therein, etc.

However, in response to determining that the location of at least one of the two or more users has changed, method 400 returns to operation 404 such that the location of each of the two or more users with respect to the current configuration of the curved display screen can be redetermined. The redetermined locations of the two or more users would thereby be used in operation 406 to determine an updated optimal configuration of the curved display screen. Further-more, operations 408 and/or 410 may be repeated in order to rotate the curved display screen according to the updated optimal angular position and/or adjust a curvature of the curved display screen according to the updated optimal radius of curvature. It follows that the processes included in method 400 may be repeated in an iterative fashion in order to maintain an optimal configuration of the curved display screen which is accurate with respect to the location, orientation, emotional state, etc. of the users in proximity to the curved display screen.

It follows that various ones of the approaches included herein present a curved display screen which is able to adjust the angular position and/or actual curvature thereof in such a way that the configuration of the display device can be adjusted to best suit the given situation. As a result, the number, location, orientation, emotional state, etc. of users in proximity to the curved display screen are taken into consideration in order to achieve an optimal configuration of the curved display screen which provides a viewing experience that takes the location of each user into account. This is particularly desirable as the optimal configuration of the curved display screen, when implemented, is able to minimize the amount of degradation in picture quality (e.g., such as trapezoidal distortion) experienced among the users as a whole. In other words, some of the approaches included herein are able to derive an optimal configuration of the curved display screen which maximizes the combined viewing experience of the users. Moreover, other approaches included herein are able to derive an optimal configuration of the curved display screen which maximizes the weighted viewing experience of the users based on their respective orientation, emotional state, field of view, etc., with respect to the curved display screen.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a LAN or a WAN, or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Moreover, a system according to various embodiments may include a processor and logic integrated with and/or executable by the processor, the logic being configured to perform one or more of the process steps recited herein. The processor may be of any configuration as described herein, such as a discrete processor or a processing circuit that includes many components such as processing hardware, memory, I/O interfaces, etc. By integrated with, what is meant is that the processor has logic embedded therewith as hardware logic, such as an application specific integrated circuit (ASIC), a FPGA, etc. By executable by the processor, what is meant is that the logic is hardware logic; software logic such as firmware, part of an operating system, part of an application program; etc., or some combination of hardware and software logic that is accessible by the processor and configured to cause the processor to perform some functionality upon execution by the processor. Software logic may be stored on local and/or remote memory of any memory type, as known in the art. Any processor known in the art may be used, such as a software processor module and/or a hardware processor such as an ASIC, a FPGA, a central processing unit (CPU), an integrated circuit (IC), a graphics processing unit (GPU), etc.

It will be clear that the various features of the foregoing systems and/or methodologies may be combined in any way, creating a plurality of combinations from the descriptions presented above.

It will be further appreciated that embodiments of the present invention may be provided in the form of a service deployed on behalf of a customer to offer service on demand.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A computer-implemented method, comprising:

detecting two or more users in proximity to a curved display screen;

determining a location of each of the two or more users with respect to a current configuration of the curved display screen by:

determining a distance between each user and a respective reference point on the curved display screen, and determining, for each user, an angle between a radius of curvature which extends from the respective reference point on the curved display screen and a line extending between the user and the reference point;

assigning a weight to each of the two or more users, wherein the weight assigned to a given user is based on an amount of attention the given user is paying to what is being displayed on the curved display screen;

using the locations of the two or more users to determine an optimal configuration of the curved display screen, wherein the optimal configuration of the curved display screen includes an optimal angular position of the curved display screen and an optimal curvature;

sending one or more instructions to rotate the curved display screen according to the optimal angular position; and sending one or more instructions to adjust a curvature of the curved display screen according to the optimal curvature, wherein the weight assigned to a given user is based on an orientation of the given user with respect to the curved display screen, wherein the weights assigned to the two or more users are also used to determine the optimal configuration of the curved display screen.

2. The computer-implemented method of claim 1, wherein the weight assigned to the given user is based on an emotional state of the given user, wherein the emotional state of the given user is determined using a form of analysis selected from the group consisting of: facial recognition, gesture recognition, speech analysis, thermal imaging, and pattern recognition.

3. The computer-implemented method of claim 1, wherein determining the location of each of the two or more users with respect to the current configuration of the curved display screen is performed using a detector selected from the group consisting of: a depth sensor, an infrared sensor, and a wireless receiver.

4. The computer-implemented method of claim 1, comprising:

monitoring the location of each of the two or more users with respect to the current configuration of the curved display screen;

determining whether the location of any of the two or more users has changed;

in response to determining that the location of at least one of the two or more users has changed, redetermining the location of each of the two or more users with respect to the current configuration of the curved display screen;

using the redetermined locations of the two or more users to determine an updated optimal configuration of the curved display screen, wherein the updated optimal configuration of the curved display screen includes an updated optimal angular position of the curved display screen and an updated optimal curvature;

sending one or more instructions to rotate the curved display screen according to the updated optimal angular position; and sending one or more instructions to adjust a curvature of the curved display screen according to the updated optimal curvature.

5. The computer-implemented method of claim 4, wherein monitoring the location of each of the two or more users with respect to the current configuration of the curved display screen is performed at a sample rate which is in a range of about once every five seconds to about once every five minutes, wherein the optimal configuration of the curved display screen is determined using, for each of the two or more users:

an angle between a reference line at the given user's position and a first imaginary line which extends between the given user and a second reference point on the curved display screen, an angle between the reference line at the given user's position and a second imaginary line which extends between the given user and a third reference point on the curved display screen, and an angle between the first or second imaginary line and a radius of curvature extending from the second or third reference point, respectively.

6. The computer-implemented method of claim 1, wherein the curved display screen is a flexible display screen.

7. A computer program product comprising a computer readable storage medium having program instructions embodied therewith, wherein the computer readable storage medium is not a transitory signal per se, the program instructions readable and/or executable by a processor to cause the processor to perform a method comprising:

detecting, by the processor, two or more users in proximity to a curved display screen;

determining, by the processor, a location of each of the two or more users with respect to a current configuration of the curved display screen by:

determining a distance between each user and a respective reference point on the curved display screen, and determining, for each user, an angle between a radius of curvature which extends from the respective reference point on the curved display screen and a line extending between the user and the reference point;

assigning, by the processor, a weight to each of the two or more users;

using, by the processor, the locations of the two or more users and the weights assigned to the two or more users to determine an optimal configuration of the curved display screen, wherein the optimal configuration of the curved display screen includes an optimal angular position of the curved display screen and an optimal curvature;

sending, by the processor, one or more instructions to rotate the curved display screen according to the optimal angular position; and sending, by the processor, one or more instructions to adjust a curvature of the curved display screen according to the optimal curvature wherein the weight assigned to a given user is based on: an amount of attention the given user is paying to what is being displayed on the curved display screen, a distance between the given user and the curved display screen, and an orientation of the given user with respect to the curved display screen, wherein the optimal configuration of the curved display screen minimizes an average viewing angle of the two or more users detected in proximity to the curved display screen.

8. The computer program product of claim 7, wherein the weight assigned to the given user is based on an emotional state of the given user, wherein the emotional state of the given user is determined using facial recognition, and/or gesture recognition.

9. The computer program product of claim 7, wherein determining the location of each of the two or more users with respect to the current configuration of the curved display screen is performed using a wireless receiver.

10. The computer program product of claim 7, the program instructions readable and/or executable by the processor to cause the processor to perform the method comprising:

monitoring, by the processor, the location of each of the two or more users with respect to the current configuration of the curved display screen;

determining, by the processor, whether the location of any of the two or more users has changed;

in response to determining that the location of at least one of the two or more users has changed, redetermining, by the processor, the location of each of the two or more users with respect to the current configuration of the curved display screen;

using, by the processor, the redetermined locations of the two or more users to determine an updated optimal configuration of the curved display screen, wherein the updated optimal configuration of the curved display screen includes an updated optimal angular position of the curved display screen and an updated optimal curvature;

sending, by the processor, one or more instructions to rotate the curved display screen according to the updated optimal angular position; and sending, by the processor, one or more instructions to adjust a curvature of the curved display screen according to the updated optimal curvature.

11. The computer program product of claim 10, wherein monitoring the location of each of the two or more users with respect to the current configuration of the curved display screen is performed at a sample rate which is in a range of about once every five seconds to about once every five minutes.

12. The computer program product of claim 7, wherein the curved display screen is a flexible display screen, wherein the optimal configuration of the curved display screen is determined using the equation:

$$\text{optimal}(r, c) = \text{argmin}_{r,c} \sum_{u \in users} \frac{1}{\varphi_{end}(u) - \varphi_{start}(u)} \int_{\varphi_{start}(u)}^{\varphi_{end}(u)} \theta(r, c, \varphi) d\varphi$$

where c is the curvature of the curved display screen, where r is the rotational position of the curved display screen, where u is the given user, where $\text{argmin}_{r,c}$ is a function which minimizes an average viewing angle of the two or more users, where $\varphi_{start}(u)$ is an angle between a reference line at the given user's position and a first imaginary line which extends between the given user and a second reference point on the curved display screen, where $\varphi_{end}(u)$ is an angle between the reference line at the given user's position and a second imaginary line which extends between the given user and a third reference point on the curved display screen, where θ is an angle between the first or second imaginary line and a radius of curvature extending from the second or third reference point, respectively.

13. A system, comprising:

a processor; and logic integrated with the processor, executable by the processor, or integrated with and executable by the processor, the logic being configured to:

detect, by the processor, two or more users in proximity to a curved display screen;

determine, by the processor, a location of each of the two or more users with respect to a current configuration of the curved display screen by:

determining a distance between each user and a respective reference point on the curved display screen, and determining, for each user, an angle between a radius of curvature which extends from the respective reference point on the curved display screen and a line extending between the user and the reference point;

assign, by the processor, a weight to each of the two or more users, wherein the weight assigned to a given user is based on an orientation of the given user with respect to the curved display screen;

use, by the processor, the locations of the two or more users and the weights assigned to the two or more users to determine an optimal configuration of the curved display screen, wherein the optimal configuration of the curved display screen includes an optimal angular position of the curved display screen and an optimal curvature; send, by the processor, one or more instructions to rotate the curved display screen according to the optimal angular position; and send, by the processor, one or more instructions to adjust a curvature of the curved display screen according to the optimal curvature, wherein the curved display screen is a flexible display screen, wherein the weight assigned to the given user is based on: an emotional state of the given user, and an amount of attention the given user is paying to what is being displayed on the curved display screen, wherein the optimal configuration of the curved display screen minimizes an average viewing angle of the two or more users detected in proximity to the curved display screen.

14. The system of claim 13, wherein determining the location of each of the two or more users with respect to the current configuration of the curved display screen is performed using at least two detectors selected from the group consisting of: a depth sensor, an infrared sensor, and a wireless receiver, wherein the optimal configuration of the curved display screen is determined using, for each of the two or more users:

an angle between a reference line at the given user's position and a first imaginary line which extends between the given user and a second reference point on the curved display screen, an angle between the reference line at the given user's position and a second imaginary line which extends between the given user and a third reference point on the curved display screen, and an angle between the first or second imaginary line and a radius of curvature extending from the second or third reference point, respectively.

15. The system of claim 13, the logic being configured to:

monitor, by the processor, the location of each of the two or more users with respect to the current configuration of the curved display screen;

determine, by the processor, whether the location of any of the two or more users has changed;

in response to determining that the location of at least one of the two or more users has changed, redetermine, by the processor, the location of each of the two or more users with respect to the current configuration of the curved display screen;

use, by the processor, the redetermined locations of the two or more users to determine an updated optimal configuration of the curved display screen, wherein the updated optimal configuration of the curved display screen includes an updated optimal angular position of the curved display screen and an updated optimal curvature;

send, by the processor, one or more instructions to rotate the curved display screen according to the updated optimal angular position; and send, by the processor, one or more instructions to adjust a curvature of the curved display screen according to the updated optimal curvature.

16. The system of claim 15, wherein monitoring the location of each of the two or more users with respect to the current configuration of the curved display screen is performed at a sample rate which is in a range of about once every five seconds to about once every one minute.

17. The system of claim 13, wherein the optimal configuration of the curved display screen is determined using the equation:

$$\text{optimal}(r, c) = \text{argmin}_{r,c} \sum_{u \in users} \frac{w_u}{\varphi_{end}(u) - \varphi_{start}(u)} \int_{\varphi_{start}(u)}^{\varphi_{end}(u)} \theta(r, c, \varphi) d\varphi$$

where c is the curvature of the curved display screen, where r is the rotational position of the curved display screen, where $w_u$ is the weight assigned to the given user u, where $\text{argmin}_{r,c}$ is a function which minimizes the average viewing angle of the two or more users, where $\varphi_{start}(u)$ is an angle between a reference line at the given user's position and a first imaginary line which extends between the given user and a second reference point on the curved display screen, where $\varphi_{end}(u)$ is an angle between the reference line at the given user's position and a second imaginary line which extends between the given user and a third reference point on the curved display screen, where θ is an angle between the first or second imaginary line and a radius of curvature extending from the second or third reference point, respectively.

* * * * *